United States Patent [19]

Mola

[11] 4,430,388

[45] Feb. 7, 1984

[54] METHOD AND APPARATUS FOR CONTINUOUSLY CASTING A HOLLOW METAL BLANK, AND THE RESULTING BLANK

[75] Inventor: Michel Mola, Paris, France

[73] Assignee: Creusot-Loire-Vallourec, Paris, France

[21] Appl. No.: 3,662

[22] Filed: Jan. 15, 1979

[51] Int. Cl.[3] ..... B22D 27/02

[52] U.S. Cl. ..... 428/595; 164/460; 164/464; 164/468; 164/504; 164/421

[58] Field of Search ..... 164/49, 147, 85, 84, 164/460, 464, 468, 263, 421, 504

[56] References Cited

U.S. PATENT DOCUMENTS

| | | | |
|---|---|---|---|
| 3,346,036 | 10/1967 | Tarmann | 164/85 |
| 3,804,147 | 4/1974 | Babel et al. | 164/147 |
| 4,016,926 | 4/1977 | Yomada et al. | 164/49 |
| 4,137,961 | 2/1979 | Mola | 164/49 |

FOREIGN PATENT DOCUMENTS

| | | | |
|---|---|---|---|
| 2552612 | 12/1977 | France | 164/49 |
| 422886 | 6/1975 | U.S.S.R. | 164/147 |

*Primary Examiner*—Kuang Y. Lin

*Attorney, Agent, or Firm*—Brisebois & Kruger

[57] ABSTRACT

A hollow blank, preferably of steel, for continuously casting by pouring molten metal into a continuous casting mold, withdrawing a shell containing liquid metal continuously from the lower end of the mold, directing the shell along a curved path, rotating the liquid metal in the mold, rotating the liquid metal in the shell at a location spaced from the mold to form a hollow in the liquid metal, and allowing the metal to solidify against the inside of the metal shell in the region of the hollow, to form a hollow metal blank. The blank thus formed can be straight or curved, and is cut off after the final solidification. An apparatus for forming the blank is disclosed and the blank thus formed has unique good quality surface characterictics free of dendrites.

4 Claims, 1 Drawing Figure

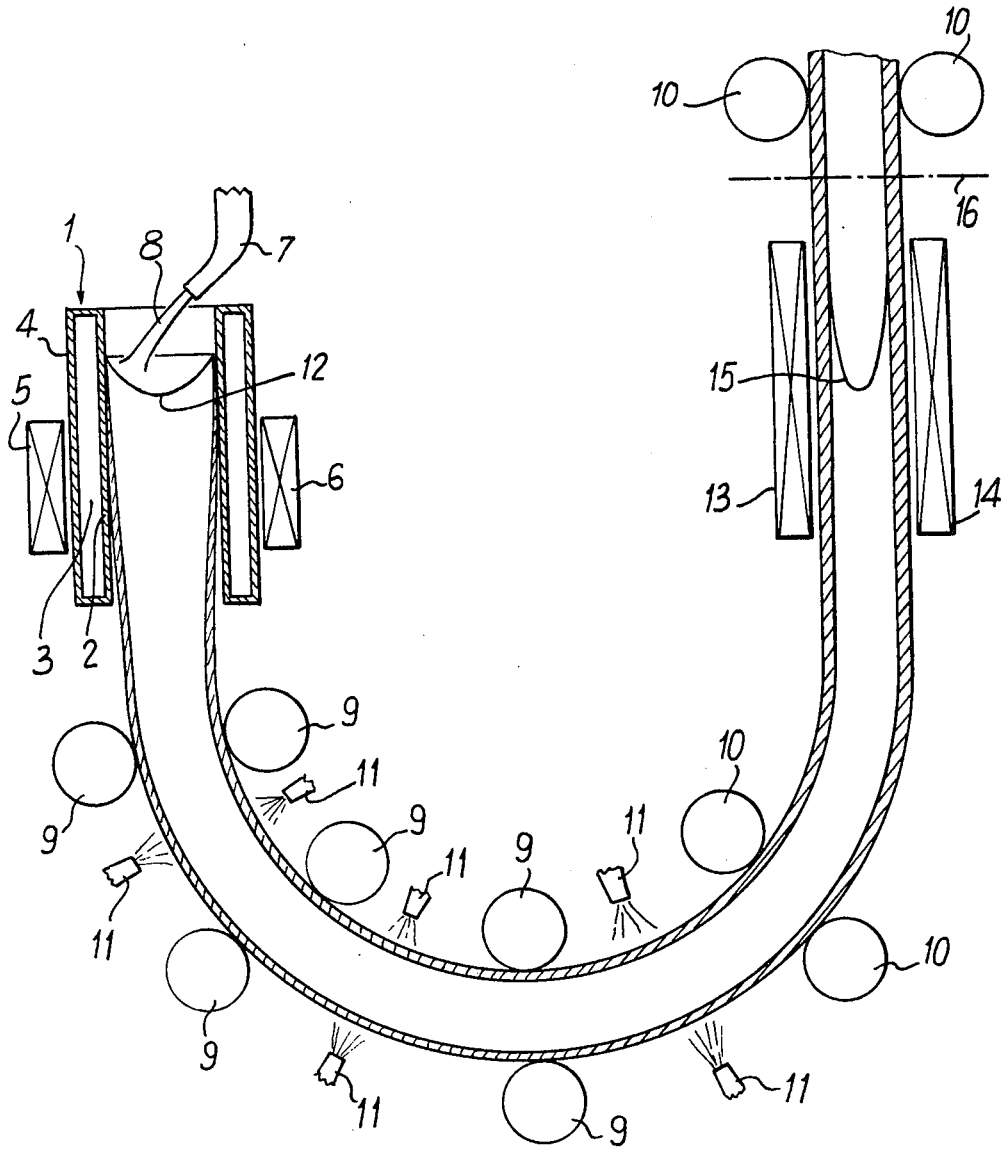
1
2
3
4
5
6
7
8
9
10
11
12
13
14
15
16

METHOD AND APPARATUS FOR CONTINUOUSLY CASTING A HOLLOW METAL BLANK, AND THE RESULTING BLANK

SUMMARY OF THE INVENTION

The present invention relates to a process for the continuous casting of hollow metal blanks, for example, from steel. The invention also relates to apparatus for carrying out the process, and also to the hollow blanks obtained by this process.

It is not presently possible to obtain by a process of continuous casting, hollow metallic blanks having an internal skin of good quality.

Applicant's assignee has already suggested in U.S. Pat. Nos. 3,804,147 and 4,137,961 for the production of solid metal blanks a process in which liquid metal is poured into a mold of circular cross-section preferably with a substantially vertical axis, continuously cooling the wall of the mold, rotating the liquid metal in the mold by means of electro-magnetic field windings energized at low-frequency and placed in or at the level of the mold, and continuously withdrawing the solid blank at the bottom of the mold.

This method cannot be used to form hollow blanks unless an interior mandrel is used.

The process according to the invention generally uses the steps of the above procedure and is characterized further essentially by the fact that a blank is extracted, in the course of solidification at the bottom of the mold, along a curved path, that rotation of the metal in the interior of the blank is achieved by means of a second set of electro-magnetic field windings energized at a frequency in the range of 50 Hz to 300 Hz placed along the curved path of the casting essentially at the level or height of the casting mold, and the blank is cut off above the second set of electro-magnetic field windings.

Applicant, as a result of considerable research has surprisingly discovered that by placing such a second set of electro-magnetic field windings operating at the indicated frequencies, essentially at the level of the casting mold near the end of the curved path of the blank, a hollow blank of excellent quality is obtained during solidification of the metal.

The second set of electro-magnetic windings is so arranged as to provide a horizontally rotating field capable of driving the liquid metal within the solidified outer wall at a speed of rotation more than 100 revolutions per minute and in general on the order of 200 rev./min. and more.

This high speed of rotation of the metal in the course of solidification of the metal within the solidified outer wall causes the formation at the center of the wall of the blank, of a well or depression of approximately parabolic curvature in section, the portion of the blank in this zone of the depression taking the form of a hollow solidified tube, or blank which is extracted as such and which is cut off beyond the second set of electro-magnetic field windings.

The apparatus according to the invention comprises a circular mold for continuous casting with a cooled wall, means to fill the mold with metal, notably liquid steel, means to withdraw the blank during the course of solidification at the base of the mold and a set of electro-magnetic field windings of low frequency to cause the rotation of the metal in the mold, the apparatus being characterized by the fact that it comprises means to cause the blank coming out of the mold to take a curved course or path, a second set of electro-magnetic windings operating at a frequency between about 50 Hz and 300 Hz to rotate the metal in the middle of the blank in the course of solidification and placed at the level of the mold near the end of the curved path of the casting and means to cut off the blank beyond the second set of electro-magnetic windings.

The present invention also relates to a hollow blank produced by the process and apparatus described above, this blank being characterized by an external and internal skin of excellent quality, each having equi-axial crystallization, the dendrite region not extending to the surfaces of the blank.

In order to better understand the invention, the following non-limiting description is given and refers to the accompanying drawing.

BRIEF DESCRIPTION OF DRAWING

The single FIGURE shows a schematic view in cross-section of an apparatus according to the invention, for practising the method of the invention.

DETAILED DESCRIPTION

Referring to the single FIGURE one sees an axial cross-sectional view of a curved continuous casting installation according to the invention. This installation comprises, a cylindrical mold 1 preferably slightly truncated, defined by an interior wall 2, for example of copper, behind which is an annular cooling space 3 through which water can circulate to cool the wall 2. An outer wall 4 extends around and encloses the annular space 3.

Around the mold 1 are positioned, a certain number of induction coils 5, 6, with a predetermined angular phase difference, energized by a low frequency current, for example, between 4 and 12 hertz.

The induction coils 5, 6 could also be placed in the interior of the mold 1, for example, in space 3 to also be cooled by the circulating water.

Above the mold 1 is a liquid metal feed nozzle 7 fixed, for example, under a charge distributor or tundish, or under a ladle of liquid steel. The nozzle can advantageously be inclined and oriented to deliver an inclined stream 8 preferably forming an angle of between 30° and 60° to the vertical and offset to one side of the vertical axis of the mold.

Metal such as liquid steel which is thus poured into the mold is cooled against the wall 2 and leaves the lower end of the mold as a blank of circular section which is withdrawn continuously, for example, between the guide rollers 9 and the extractor rollers 10, and driven as shown on the drawing along a curved path, in the same manner as in conventional continuous casting devices. Conventional secondary cooling nozzles 11 are placed around the curved course or path.

The electro-magnetic fields created by the induction coils 5, 6 cause rotation of the liquid metal in the interior of the mold about the vertical geometrical axis of the mold which forms a meniscus 12 at the surface of the metal in the hold.

According to the invention to obtain a hollow blank, electro-magnetic field coils 13, 14 are placed near the end of the curved U-shaped path of continuous casting, these coils rotating the liquid metal, in the process of solidification, in the central part of the solidified wall of the blank, to create in the center of the blank a relatively long depression of parabolic section 15, the blank thus leaving the zone of the induction coils 13, 14 in the form of a hollow pipe like blank, the thickness of the wall being determined by the depth of the depression and the speed of rotation of the metal caused by the induction coils.

Shown schematically by line 16 is a blank cut off device which can be a conventional travelling saw type blank cutting device. If the blank is drawn out vertically in a straight line from the second set of induction coils, a straight blank results. Of course if the blank is drawn out along a curved path beyond the second set of coils, curved blanks result.

By way of example, the process according to the invention was used for continuous curved casting of hollow steel blanks with an exterior diameter of 223 mm using a mold 1 having a total height of 600 mm, the height of the mold induction coils 5, 6 being 300 mm, and the height of the inductions coils 13, 14 placed toward the end of the path being 600 mm. The radius of the arc of casting was 4000 mm. The mold inductions coils 5, 6 were supplied with a two-phase current having a frequency of 4 Hz and the induction coils placed near the end of the path were supplied with a three-phase current having a frequency of 200 Hz.

Thus it has been possible to obtain, according to the invention, hollow blanks with a length of 3 mm and a wall thickness of 60 mm. The hollow blank obtained has excellent internal and external skin qualities.

What is claimed is:

1. A process for continuous casting of hollow metallic blanks comprising the steps of:

(a) pouring molten liquid metal into a continuously cooled mold of circular cross-section, (b) rotating the liquid metal in the mold by submitting it to a low frequency first electromagnetic field, (c) substantially continuously withdrawing a blank having a solidified shell with liquid metal therein downwardly from the bottom of the mold and then directing the blank along a generally U-shaped curved path so that the blank has an ascending portion at a first location spaced horizontally from the mold at an elevation substantially the same as the elevation of the mold, (d) rotating at a speed over 100 r.p.m. the liquid metal in said ascending portion of the blank by submitting said blank adjacent said first location to a horizontally rotating second electromagnetic field of a frequency in the range of 50 Hz to 300 Hz, and (e) cutting off the hollow blank thus formed at a second location above said first location and at an elevation above that of the mold.

2. Apparatus for continuous casting of hollow metallic blanks comprising, an annular casting mold having a generally vertical axis, means for supplying liquid metal to the mold, means for rotating liquid metal in the mold generally about the axis of the mold comprising, a first inductive winding energized with a low frequency current and located within or adjacent said mold, means for continuously withdrawing a blank having a solidified shell containing liquid metal therein downwardly from the bottom of the mold, means for directing said blank along a generally U-shaped curved path first downwardly and then upwardly so that the blank has an ascending portion at a first location spaced horizontally from the mold and at substantially the same elevation as said mold, means comprising a second inductive winding adjacent said first location energized with current at a frequency in the range of 50 Hz to 300 Hz, for rotating the liquid metal in said ascending portion of the blank at a speed of rotation over 100 r.p.m., and means for cutting off the hollow blank thus formed at a second location above said first location and at an elevation above the elevation of the mold.

3. A hollow metal blank having excellent external and internal skin qualities each of equi-axial crystallization and free of dendrites, said blank being formed by the process according to claim 1.

4. A hollow metal blank according to claim 3 wherein said blank is straight.

* * * * *

UNITED STATES PATENT AND TRADEMARK OFFICE

CERTIFICATE OF CORRECTION

PATENT NO. : 4,430,388

DATED : February 7, 1984

INVENTOR(S) : Michel Mola

It is certified that error appears in the above-identified patent and that said Letters Patent is hereby corrected as shown below:

On the title page insert:

-- [30] Foregin Application Priority Data

January 23, 1978 France....78 01761 --.

Signed and Sealed this

Eighth Day of May 1984

[SEAL]

*Attest:*

GERALD J. MOSSINGHOFF

*Attesting Officer* *Commissioner of Patents and Trademarks*